United States Patent [19]

Sawada

[11] Patent Number: 4,789,359

[45] Date of Patent: Dec. 6, 1988

[54] FIXED-TERMINAL STRUCTURE

[75] Inventor: Kenji Sawada, Furukawa, Japan

[73] Assignee: Alps Electric Co., Ltd., Japan

[21] Appl. No.: 77,979

[22] Filed: Jul. 27, 1987

Related U.S. Application Data

[63] Continuation of Ser. No. 864,712, May 19, 1986, abandoned.

[30] Foreign Application Priority Data

May 17, 1985 [JP] Japan ..... 60-73133[U]

[51] Int. Cl.[4] ..... H01R 13/70

[52] U.S. Cl. ..... 439/620; 200/275

[58] Field of Search ..... 200/275; 439/83, 620, 439/78, 79, 80, 81, 527, 569

[56] References Cited

U.S. PATENT DOCUMENTS

| | | | |
|---|---|---|---|
| 4,239,321 | 12/1980 | Bauer | 339/276 T |
| 4,253,234 | 3/1981 | Niles et al. | 339/276 T |
| 4,541,034 | 9/1985 | Fanning | 339/17 C |
| 4,592,617 | 6/1986 | Seidler | 439/83 |
| 4,623,206 | 11/1986 | Fuller | 339/17 C |

*Primary Examiner*—Gil Weidenfeld
*Assistant Examiner*—Gary F. Paumen
*Attorney, Agent, or Firm*—Guy W. Shoup; Leighton K. Chong; Paul J. Winters

[57] ABSTRACT

A fixer-terminal structure rigidly fixed to the outside of the casing of a switch adapted for automotive power window. The front ends of the fixed terminals are bent through an angle of at least 90° such that their corners are curved, so that any lead wire which comes into contact with the front ends of the terminals will not break.

2 Claims, 4 Drawing Sheets

FIXED-TERMINAL STRUCTURE

This is a continuation application from application Ser. No. 864,712 filed May 19, 1986, now abandoned.

FIELD OF THE INVENTION

The present invention relates to a fixed-terminal structure and, more particularly, to the structure of fixed terminals in a switch mainly used for a motor, the fixed terminals being especially rigidly fixed to the outside of the casing of a switch for an automotive power window.

BACKGROUND OF THE INVENTION

Conventionally, fixed terminals of this kind have been so made that their front ends are straight. Therefore, if a lead wire comes into contact with such a front end, an accident such as a short circuit will take place.

SUMMARY OF THE INVENTION

It is an object of the present invention to provide a fixed-terminal structure which is free of the foregoing problem with the prior art techniques and which can prevent lead wires from breaking.

The above object is achieved by a fixed-terminal structure having terminals whose front ends are bent through an angle of at least 90° at their corners, whereby any lead wire coming into contact with the terminal structure is prevented from breaking.

DETAILED DESCRIPTION OF THE INVENTION

Figure 1:
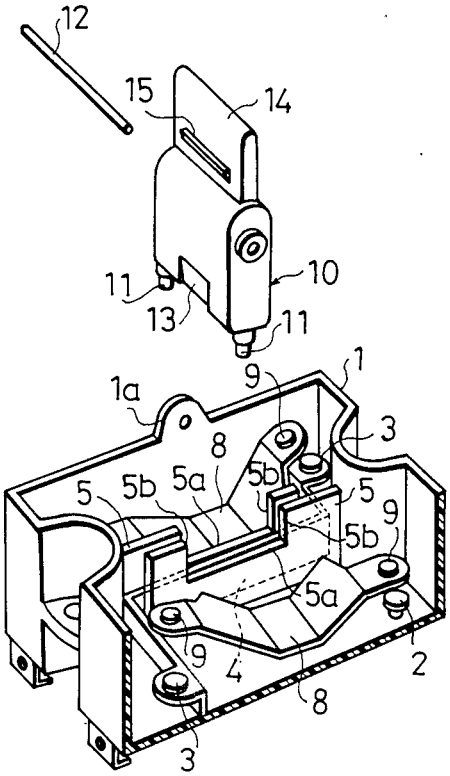
FIG. 1 is an exploded perspective view of a motor switch to which the invention is applied, the casing of the switch being partially omitted.
Figure 2:
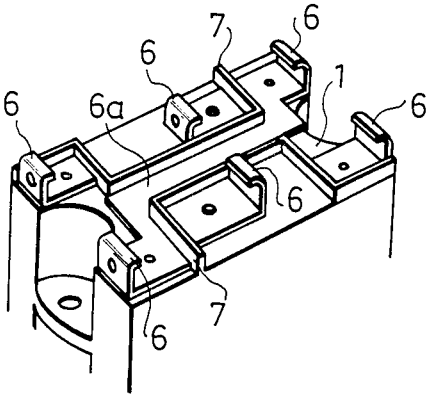
FIG. 2 is a perspective view of the switch shown in FIG. 1, as viewed from above the bottom of the casing.
Figure 3:
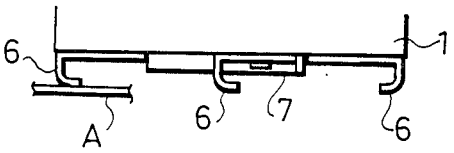
FIG. 3 is a fragmentary bottom view of the bottom portion of the switch shown in FIGS. 1 and 2.
Figure 4:
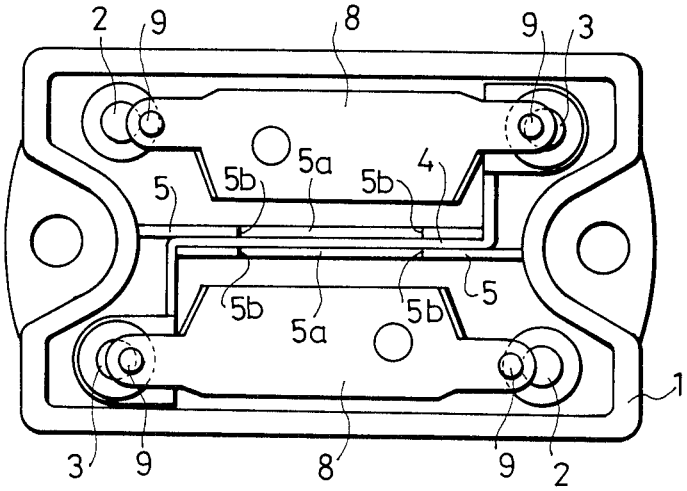
FIG. 4 is a plan view of the switch shown in FIGS. 1-3, and in which the operation member is omitted.

Referring to the drawings, there is shown a switch having a terminal structure according to the invention. This switch has a casing 1 having an opening on its upper side. Fixed contacts 2 for energization are fixed to the bottom of the casing 1. Also, fixed contacts 3 are fixed to the bottom. The contacts 2 are disposed in a diametrically opposite relation with respect to the center of the bottom of the casing 1. Also, the contacts 3 are disposed in a diametrically opposite relation with respect to the center of the bottom. The fixed contacts 3 are connected together by a crank-shaped connector member 4. This connector member 4 has a straight plate portion which is held between barriers 5 extending upwardly from the casing 1. Each barrier 5 is provided with a recess **5*a* at the center of the upper fringe. An operation member (described later) extends over the recesses 5*a*. Stopper portions 5*b* are formed in neighboring relation to the recesses 5*a***.

Connecting, fixed terminals 6 are rigidly fixed to the reverse side of the casing 1. The front end of each terminal 6 is bent into an L-shaped form such that its corner is curved, in order that a lead wire A does not break when it comes into contact with the front end. In the present example, the front end is bent through an angle of about 90°. It is also possible to bend it through a larger angle. Those fixed terminals 6 which are connected with the fixed contacts 2 for energization are connected together by a connector member **6*a*. L-shaped barriers 7 are formed between the terminals 6. When the terminals 6 are mounted, the barriers 7** prevent them from turning.

Substantially V-shaped movable elements 8 are mounted outside the barriers 5 extending upright inside the casing 1. Movable contacts 9 are rigidly fixed to both ends of each movable element 8.

The movable elements 8 are actuated by an operation member 10 which is provided with driver rods 11 at both ends of the lower end. The front ends of the rods 11 are spherical in shape. Each rod 11 is biased by a compressed spring 18. The operation member 10 is so disposed as to extend over the recesses **5*a* of the barriers 5. A shaft 12 extends through the operation member 10, and is mounted to support portions 1*a* protruding from each center of the upper lateral fringes of the casing 1 so that the member 10 may rotate about the shaft 12**.

Figure 5:
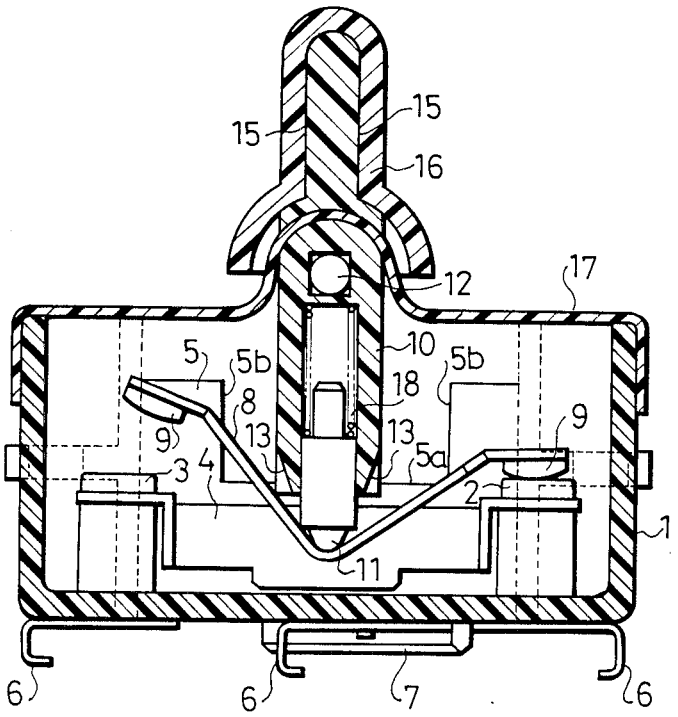
FIG. 5 is a cross-sectional view of the switch shown in FIGS. 1-4, and in which the switch has been assembled.

The operation member 10 is further provided with tapering abutting portions 13 at the center of the lower surface of the member. As the operation member 10 is tilted, either one of the abutting portions 13 abuts against corresponding ones of the stopper portions **5*b* of the barriers 5, whereby the operation member 10 can no longer move. A knob 14 extends upwardly from, and is formed integrally with, the operation member 10. The knob 14 is provided with anchoring protrusions 15 on its both sides. A cap 16 (see FIG. 5) can be detachably mounted on the cap 14 with a press fit. A waterproof casing 17** is made from rubber.

As described above, in accordance with the invention, the front ends of fixed terminals are bent to eliminate the possibility that lead wires break.

I claim:

1. A fixed terminal structure for connecting lead wires to contacts mounted on an outer planar surface of a switch casing, comprising fixed terminals, all of which have a mounting portion mounted flat on the casing and an end portion formed in an L-shape extending upright from the mounting portion and ending in a curved tip spaced above said surface, wherein the curve of each said curved tip faces in a laterally outward direction from said surface of said casing and the end of each said curved tip extends in a laterally inward direction substantially parallel to the plane of said surface of said casing, whereby a lead wire external to said casing is protected from being cut by said curve and said parallel extending end of said curved tip.

2. A fixed-terminal structure according to claim 1, wherein said curved tip has a curvature of at least ninety degrees.

* * * * *